US009393456B2

(12) United States Patent
Popov

(10) Patent No.: US 9,393,456 B2
(45) Date of Patent: Jul. 19, 2016

(54) LATERAL FOOT SLIDING MECHANISM

(71) Applicant: Miroslav Popov, Vrsac (RS)

(72) Inventor: Miroslav Popov, Vrsac (RS)

( * ) Notice: Subject to any disclaimer, the term of this patent is extended or adjusted under 35 U.S.C. 154(b) by 0 days.

(21) Appl. No.: 14/400,418

(22) PCT Filed: May 7, 2013

(86) PCT No.: PCT/IB2013/000862
§ 371 (c)(1),
(2) Date: Nov. 11, 2014

(87) PCT Pub. No.: WO2013/167949
PCT Pub. Date: Nov. 14, 2013

(65) Prior Publication Data

US 2015/0126337 A1 May 7, 2015

(30) Foreign Application Priority Data

May 11, 2012 (RS) ..... P-2012/0198
Apr. 30, 2013 (RS) ..... P-2013/0173

(51) Int. Cl.
*A63B 69/18* (2006.01)
*A63B 21/00* (2006.01)
(Continued)

(52) U.S. Cl.
CPC ..... *A63B 21/1488* (2013.01); *A63B 21/00192* (2013.01); *A63B 21/4015* (2015.10); *A63B 21/4034* (2015.10); *A63B 21/4045* (2015.10);
(Continued)

(58) Field of Classification Search
CPC ..... A63B 23/00; A63B 23/035; A63B 23/04; A63B 23/0417; A63B 23/0227; A63B 22/00; A63B 22/20; A63B 22/201; A63B 22/203; A63B 22/205; A63B 21/00; A63B 21/005; A63B 21/000192; A63B 21/14; A63B 21/1423; A63B 21/1426; A63B 21/143; A63B 23/08; A63B 21/0052; A63B 22/0076; A63B 22/0087; A63B 22/0089; A63B 69/18; A63B 69/182; A63B 69/0022; A63B 21/1488
USPC ..... 482/51, 70–71, 79–80
See application file for complete search history.

(56) References Cited

U.S. PATENT DOCUMENTS 3,159,400 A * 12/1964 Brass ..... A63B 69/18 273/109
5,328,427 A * 7/1994 Sleamaker ..... A63B 21/4045 482/110

(Continued)

*Primary Examiner* — Oren Ginsberg
*Assistant Examiner* — Andrew S Lo
(74) *Attorney, Agent, or Firm* — The Watson I.P. Group, PLC; Jovan N. Jovanovic; Vladon M. Vasiljevic

(57) ABSTRACT

This invention relates to a lateral foot sliding mechanism in the field of sport activities, training devices, and more particularly exercise machines, especially adapted to lower extremities. The lateral foot sliding mechanism includes a low platform (1) with a profiled groove (5) in the mid along the platform (1), in which two foot sliding mechanisms move (2), which have two foot supports (6,7) and are equipped with elements (11), which enable lateral movement of the slide mechanisms (2) along the platform (1). In the support (10) of the sliding mechanism (2), a magnetic insert is positioned (16), which can be, with the positioned sliding mechanism (2) in the platform (1), moved forward or backward by the mechanism by means of which you act on the simple end of the magnetic insert (16) and which is equipped with a button (18) through which an exerciser may move inward and outward the magnetic insert (16), thus adjusting the load—that is the brake force of each sliding mechanism (2)—with moving the magnetic insert (16) towards or from the platform (1).

3 Claims, 3 Drawing Sheets

(51) Int. Cl.
*A63B 23/035* (2006.01)
*A63B 23/04* (2006.01)

(52) U.S. Cl.
CPC ..... *A63B 23/03541* (2013.01); *A63B 23/0488* (2013.01)

(56) References Cited

U.S. PATENT DOCUMENTS 5,749,811 A * 5/1998 Wilson ..... A63B 69/18 434/253
5,855,538 A * 1/1999 Argabright ..... A63B 23/03533 482/70
6,368,254 B1 * 4/2002 Wall ..... A63B 21/055 482/122
6,514,180 B1 * 2/2003 Rawls ..... A63B 21/005 482/51
7,686,741 B2 * 3/2010 Larson ..... A63B 22/203 482/54
8,128,540 B2 * 3/2012 Savsek ..... A63B 21/0455 482/121
8,894,551 B2 * 11/2014 Kerdjoudj ..... A63B 21/018 482/70
2004/0242381 A1 * 12/2004 Parmater ..... A63B 22/205 482/71
2007/0037672 A1 * 2/2007 Nakanishi ..... A61H 1/0266 482/79
2007/0179027 A1 * 8/2007 Van Straaten ..... A63B 22/14 482/71
2009/0176631 A1 * 7/2009 Blessing ..... A63B 22/0061 482/71
2010/0167883 A1 * 7/2010 Grind ..... A63B 22/001 482/71
2011/0003666 A1 * 1/2011 Raumann ..... A63B 22/0015 482/79
2011/0152036 A1 * 6/2011 Halver ..... A63B 21/157 482/51

* cited by examiner

LATERAL FOOT SLIDING MECHANISM

TECHNICAL FIELD

The present invention relates to a lateral foot sliding mechanism in the field of sport activities, that is training equipment, and more particularly exercise machines, especially adapted to lower extremities. The invention may be included into A63B 21/00 class of the International Patent Classification.

TECHNICAL PROBLEM

The technical problem, completely solved by the present invention, relates to the construction of such a machine, which solves the problem of strength development, speed and lower extremities muscular endurance when moving legs laterally, and at the same time having an easy load adjustment for both legs, independently, as for the LH leg so for the RH leg in both directions.

TECHNIQUE STATUS

Construction embodiments used and known to the Patentee, are embodiments that use flexible rubber straps, tied to the exerciser's legs and when moving leg outwards and inwards he pulls only one side while the other leg is static. After a longer use, the rubber looses its flexibility and it often happens that it brokes and injuries occur to the exercisers. In addition, it is difficult to determine and adjust the level of resistance with the rubber straps.

Thus, according to the invention described in the Patent Document US 2007/0117693 it relates to a combined training device, capable of exercising both the upper body and for the lateral leg movements. The device according to this invention is capable of adjustable blocking of the lateral leg movement slides, and the load unable to be adjusted, is controlled only by rubber band stretching. Disadvantages of this embodiment are as in the previous embodiments related to the use of a rubber as a tension element.

There is a design according to the invention, described by the Patent Document U.S. Pat. No. 5,328,427, where the lateral movement of the foot sliding mechanisms is adjusted with the rope mechanism, which is complex for the manufacture, has a number of precise accompanying parts and is therefore delicate for use and disposed to failures.

BACKGROUND OF THE INVENTION

The lateral foot sliding mechanism, according to this invention, solves the indicated technical problem by a design embodiment shown in the accompanying drawings.

The lateral foot sliding mechanism consists of a law platform with a profiled groove along the mid of the platform, within which two foot sliding mechanisms move, having two foot supports and equipped with elements, which provide lateral movement of the sliding mechanisms 2 along the platform. Into a sliding mechanism support 2, a magentic insert is positioned which, can be, with the positioned slide mechanism in the platform 1, pulled up or lowered by means of the mechanism with which you act on the simple end of the magnetic insert and is equipped with a knob by means of which the exerciser can move the magnetic insert inwards or outwards and thus adjust the load—that is the brake force of each sliding mechanism—with moving the magnetic insert towards or from the platform.

DETAILED DESCRIPTION OF THE INVENTION

The lateral foot sliding mechanism, according to this invention, will be described in detail on the basis of the given example and accompanying figures, and in which.

Figure 1:
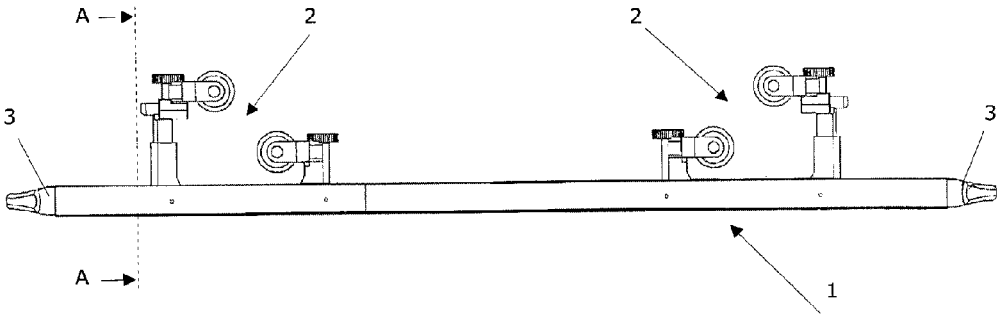
FIG. 1 is a lateral view of the lateral foot sliding mechanism according to the invention.
Figure 2:
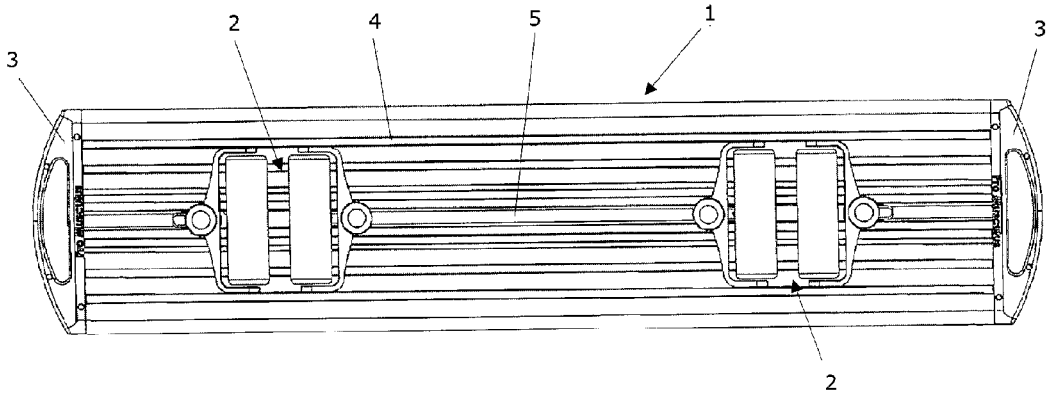
FIG. 2 is a perspective view of the lateral foot sliding mechanism according to the invention.
Figure 3:
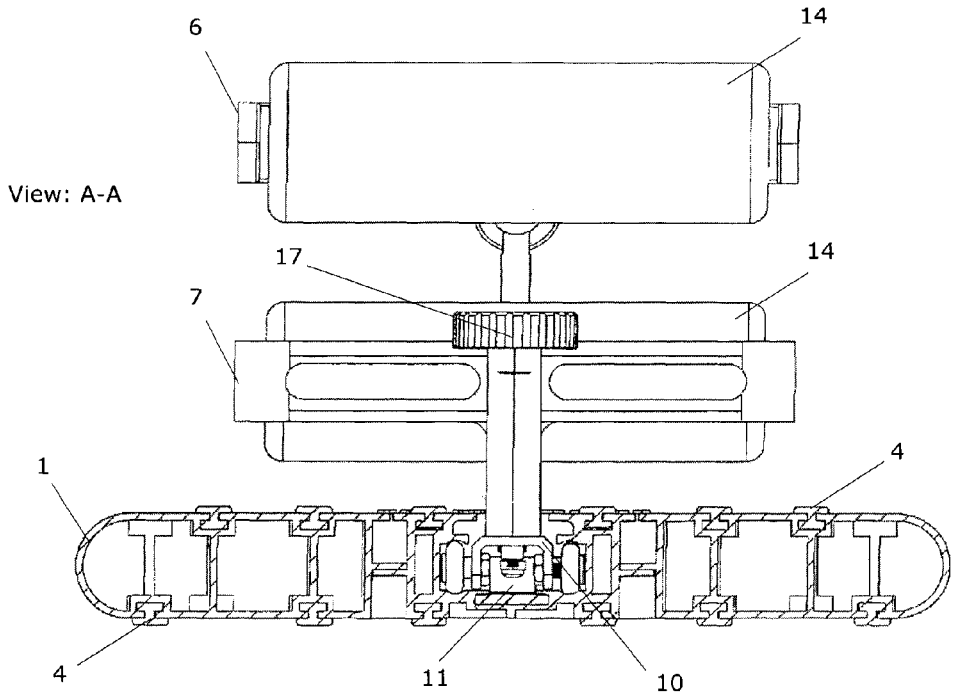
FIG. 3 is a side section view of the A-A lateral foot sliding mechanism according to the invention with the sliding mechanism.
Figure 4:
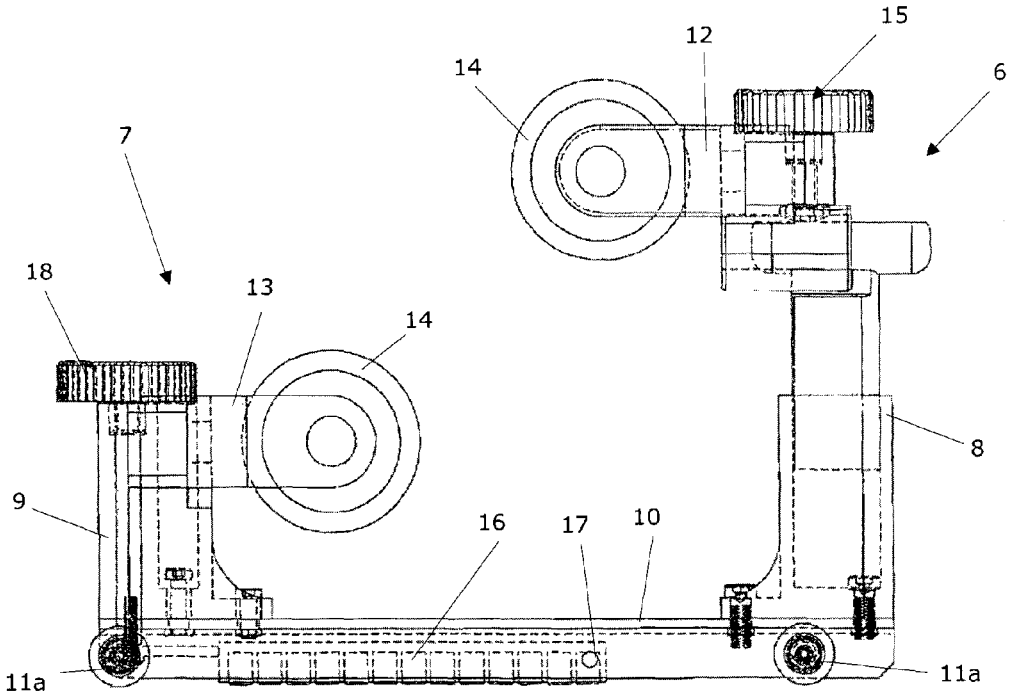
FIG. 4 is a side view of the sliding mechanism.
Figure 5:
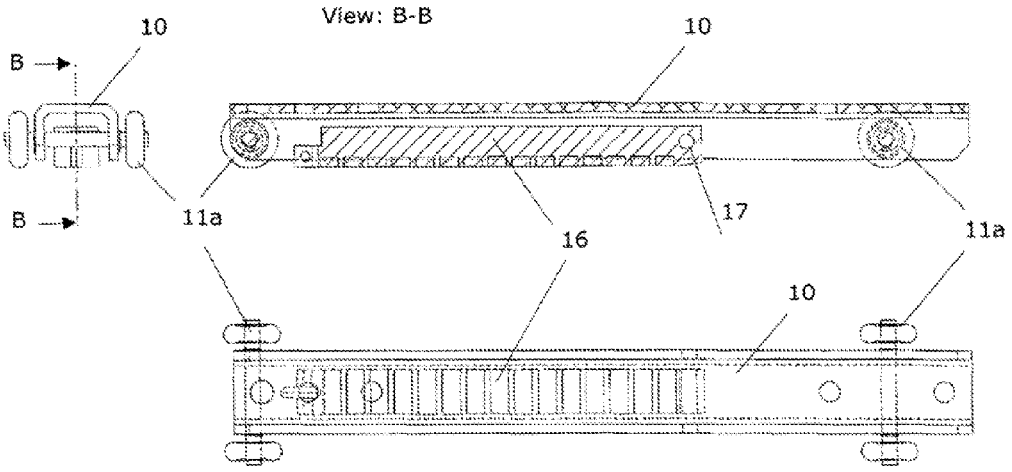
FIG. 5 is a side section view of the B-B lower part of the sliding mechanism and the perspective view with the elements 11 as wheels 11*a;*
Figure 6:
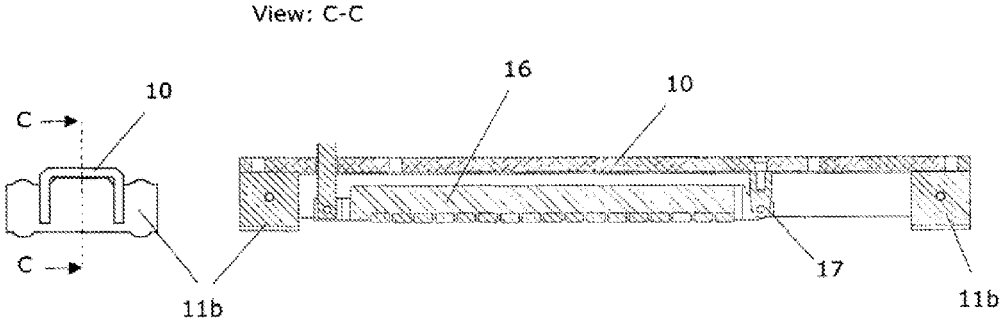
FIG. 6 is a side section view of the C-C lower part of the sliding mechanism with the elements 11 as the inserts 11*b* of the square shaped sliding plastic.

The lateral foot sliding mechanism, according to the invention, consists of the law platform 1, two foot sliding mechanisms 2 and handgrips 3, positioned on each end of the platform 1 and serve to easier handling of the device as well as to prevent dropping out of the sliding mechanisms 2 when exercising. The platform 1 has rubber profiles 4 on the top and the bottom side to prevent slipping of the device when exercising. Along the mid of the platform 1 a profiled groove is positioned 5 within which the said foot sliding mechanisms move 2.

Each sliding mechanism 2 consists of two foot supports each 6,7, where the base supports 8,9 are fixed on the upper side of the U shaped profiled support 10, and on the both ends of the profiled support 10 on the lower side the elements 11 are positioned, which provide lateral movement of the sliding mechanisms 2 along the platform 1. Dimensions of the elements 11 match the dimension of the profiled groove 5 of the platform 1. The lateral movement of the elements 11 is enabled by the construction elements such as wheels 11*a*, insert 11*b* made of square shaped sliding plastic or similar.

Into base supports 8,9 of the sliding mechanisms 2 on the upper side, holders 12,13 are positioned with the guards 14 made of foam or similar material. In the previous higher foot support 6 positioned on the inner part of the foot of the exerciser when exercising, the guide 14 can be moved horizontally and vertically by means of the mechanism controlled by the knob 15 and it can be equipped with the rod or similar element to fix the guide 14 into a desired position. The lower foot support 7 is equipped with the mechanism (e.g. threaded spindle or similar) by which you act on the simple end of the magnetic insert 16 which is positioned in the profiled support 10 of the sliding mechanism 2 whereby the other end of the magnetic insert 16 is rotationally fixed in the profiled support 10 on the fixed support 17. The mechanism by which you can act on the simple end of the magnetic insert 16 is equipped with the knob 18 by means of which the exerciser can move the magnetic insert inwards or outwards thus adjusting the load—that is the brake force of each sliding mechanism 2—by moving the magnetic insert 16 towards or from the platform 1.

According to this invention, the lateral foot sliding mechanism can be used so that the exerciser places each of his legs into its sliding mechanism 2 between the guides 14 so that the higher foot supports 6 are on the inner part between the legs of the exerciser. By means of the knob 18 he controls the load, that is the force value by which the sliding mechanism 2 is moved, and by moving one leg outwards and another leg inwards starts the right hand (RH) side left hand (LH) side lateral movement, LH side-RH side lateral movement or vice versa and in that way he strengthens the muscles participating in that movement.

Exercising on this machine, according to the invention, enables the exercisers and especially those engaged in the sport activities, whose strength-training workout and lower extremities endurance, especially of muscles and muscle groups performing the legs movement function such as moving legs to the LH side or to the RH side is of great importance such as in basketball, handball, tennis, skiing etc., faster strength workout, speed and endurance when performing the said movements. The construction of this machine, according to the invention, provides simulation of the lateral movements, no matter of the level of capabilities, age, sex, legs span, and the control of the load is easy and fast. The construction of the lateral foot sliding mechanism enables free movement, which does not limit or stipulates the footstep length, no matter of the extremities height and age. This machine can be especially used, according to the invention, even in the post-operative rehabilitation period of building up one leg strength while gently applying the load level for the quality recovery time.

The invention claimed is:

1. A lateral foot sliding mechanism comprising:

a platform having a profiled groove extending along a middle of the platform, a pair of sliding mechanisms, each sliding mechanism including a profiled support having a magnetic insert positioned along the profiled support, the profiled support positionable within the profiled groove, and including elements coupled to the profiled support which are structurally configured to facilitate the sliding of the profiled support along the profiled groove;

each sliding mechanism having two base supports fixed to an upper side of the profiled support, with a foot support coupled to each one of the base supports, one of the two base supports defining a higher foot support and one of the two base supports defining a lower foot support, with the higher foot support being adjustable in a vertical and horizontal direction; and wherein the magnetic insert has a first end that is pivotably coupled to the profiled support and a second end that is movable so as to allow the magnetic insert to pivot about the first end thereof, toward and away from the platform, with a rotatable knob extending through the lower foot support and engaging with the second end of the magnetic insert, whereupon rotation of the knob in a first direction raises the second end of the magnetic insert and the rotation of the knob in a second direction lowers the second end of the magnetic insert.

2. The lateral foot sliding mechanism, according to claim 1, wherein the elements comprise one of wheels and an insert having a square shaped slide plastic.

3. The lateral foot sliding mechanism, according to claim 1, wherein the higher foot support and the lower foot support each include a guide that comprises a foam material.

* * * * *